US006335692B1

(12) United States Patent
Compton

(10) Patent No.: US 6,335,692 B1
(45) Date of Patent: Jan. 1, 2002

(54) TIMER DEVICE FOR MEDICATION CONTAINER WITH PROGRESSIVE WARNING DISPLAY

(76) Inventor: Karen A. Compton, 1610 Waters Edge La., Reston, VA (US) 20190-4228

( * ) Notice: Subject to any disclaimer, the term of this patent is extended or adjusted under 35 U.S.C. 154(b) by 0 days.

(21) Appl. No.: 09/594,707

(22) Filed: Jun. 16, 2000

Related U.S. Application Data

(60) Provisional application No. 60/139,374, filed on Jun. 16, 1999.

(51) Int. Cl.[7] ..... G08B 5/00

(52) U.S. Cl. ..... 340/815.4; 340/309.15; 340/309.4; 340/545

(58) Field of Search ..... 340/309.15, 309.4, 340/545, 815.4; 368/2, 10, 12, 327

(56) References Cited

U.S. PATENT DOCUMENTS 5,625,334 A * 4/1997 Compton ..... 340/309.15
5,751,661 A * 5/1998 Walters ..... 368/10
5,805,051 A * 9/1998 Herrmann et al. ..... 340/309.15
5,862,101 A * 1/1999 Haas et al. ..... 368/327
5,990,782 A * 11/1999 Lee ..... 340/309
6,018,289 A * 1/2000 Sekura et al. ..... 340/309.4
6,075,755 A * 6/2000 Zarchan ..... 368/10

* cited by examiner

*Primary Examiner*—Jeffery Hofsass
*Assistant Examiner*—Hung Nguyen
(74) *Attorney, Agent, or Firm*—Crowell & Moring LLP

(57) ABSTRACT

A visual indicator for a medication container signals to the user that a medication has previously been taken within a prescribed preceding time interval and should not be taken again. A substrate with a permissive symbol or indicator printed thereon is covered by a liquid crystal display which is comprised of a series of separately activatable display segments which, when activated, block visual observation of the permissive indicator. When the container is opened and closed, initially all such display segments are activated, thus blocking or obscuring the permissive indicator. As the prescribed time interval passes, the successive display segments are sequentially deactivated, and when the prescribed time interval has expired, all such display segments are deactivated so that the permissive indicator is fully exposed to observation.

13 Claims, 3 Drawing Sheets

TIMER DEVICE FOR MEDICATION CONTAINER WITH PROGRESSIVE WARNING DISPLAY

This application claims the priority of provisional U.S. patent application No. 60/139,374, filed Jun. 16, 1999.

BACKGROUND AND SUMMARY OF THE INVENTION

The invention provides a visual indicator or display for use with medication containers that signals to the patient or user that a medication (or dietary supplement or the like) has previously been taken within a particular preceding time interval and should not be taken again.

A timer device of this generic type is disclosed in U.S. Pat. No. 5,625,334, by the inventor identified in the present application, the disclosure of which is hereby incorporated by reference in its entirety. For this purpose, the '334 patent provides a medicine (or dietary supplement) bottle cap which superimposes a liquid crystal display on top of a permissive indicator, such as a smiling face caricature of other graphic, as shown in FIGS. 5*a* and 5*b* thereof. When the bottle cap is opened and closed, the liquid crystal is energized, and created a pattern of opaque lines or bars over the permissive smiling face graphic. The liquid crystal display remains energized for a length of time equal to the timing between prescribed dosages of the medication contained in the container. When that period of time expires, so that it is permissible for the patient to take another dosage of the medication, the liquid crystal display is de-energized, so that the opaque pattern superimposed on the permissive indicator disappears. Thereafter, when the patient inspects the container lid, he or she sees the permissive indicator, signaling that it is once again permitted to take a dosage of the medication.

The signaling arrangement disclosed in the '334 patent is binary in nature. That is, it signals only that it is, or is not, permissible to take another dosage of medication. The user of the device is therefore unable to determine from inspection of the display how long it will be until the next dosage of medication is authorized.

One object of the present invention, therefore, is to provide a medication or dietary supplemental container of the type described, that signals permission for the next dosage of medication to be taken, and also provides the user with an intuitive, easily understandable visual indication of the amount of time remaining before the next medication dosage is permitted.

This and other objects and advantages are achieved by the present invention, which includes a display device in which a permissive indicator, such as a smiling face or the letters "OK" or the like, is progressively uncovered as the prescribed time between medication dosages expires. For this purpose, a substrate with the permissive indicator printed thereon is covered by a liquid crystal display comprising a series of adjacent parallel substantially opaque line segments, bars, or other display elements, which block the visual permissive indicator when the liquid crystal display device is initially energized (by removal and replacement of the container lid) in the manner disclosed in the '334 patent. The opaque line segments or bars of the liquid crystal display disappear progressively as the danger associated with taking a second dose diminishes with elapsed time. All elements of the liquid crystal display are dark at the beginning of the cycle, and none of them is dark when the time has fully expired, so that the permissive indicator under the LCD elements is fully exposed. In this manner, the user of the medication bottle is provided with an easily readable and understandable intuitive indication of the amount of time remaining before an additional dosage can be taken.

Other objects, advantages and novel features of the present invention will become apparent from the following detailed description of the invention when considered in conjunction with the accompanying drawings.

DETAILED DESCRIPTION OF THE DRAWINGS

As shown in FIG. 1, the display arrangement according to the invention includes a substrate with a permissive indicator in the form of the letters "OK" for indicating to the user of the medication container that it is permissible to take an additional dosage of the medication when the permissive display is visible. In a manner known to those skilled in the art, and as disclosed in particular in U.S. Pat. No. 5,625,334, the display arrangement also includes a liquid crystal display sandwiched on top of the printed substrate, for blocking out the permissive graphic when it is impermissible to take an additional dosage of medication.

Figure 1A:
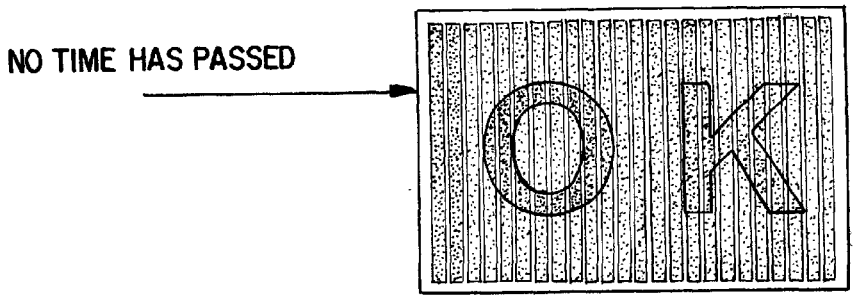
FIGS. 1*a*–1*d* illustrates the display arrangement according to the invention at four different times during the progression of the prescribed medication cycle.
Figure 1B:
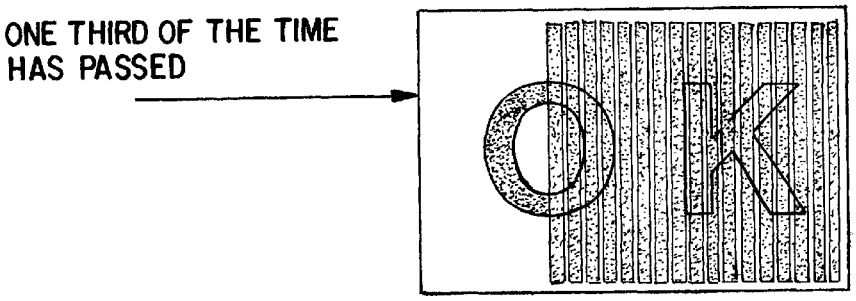
Figure 1C:
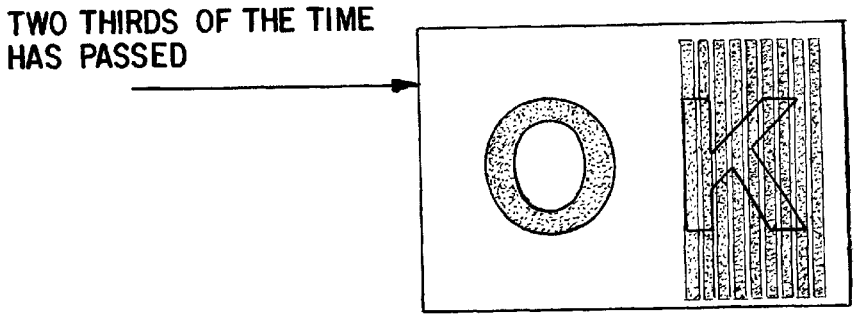
Figure 1D:
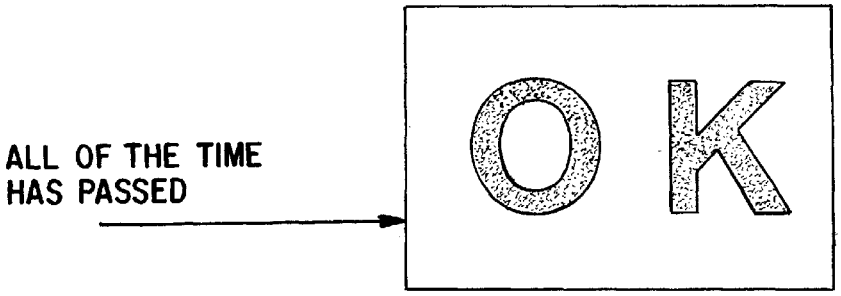

The display arrangement according to the invention includes a plurality of dark or opaque line segments or bars, etc. which may be energized separately or in groups. When the liquid crystal display is initially energized in the manner disclosed in U.S. Pat. No. 5,625,334, all of the dark line segments are energized, thus obscuring the permissive indicator "OK". However, as noted previously, as the prescribed time period between dosages of the medication expires, the dark line segments of the liquid crystal display are made to disappear sequentially, as indicated in FIGS. 1*b* and 1*c*. When the prescribed time between dosages has completely expired, the permissive indicator letters "OK" are completely visible, as shown in FIG. 1*d*. Thus, since the opaque bars are sequentially de-energized in order, the user of the medication bottle can at a glance obtain an intuitive indication of the approximate time remaining before an additional dosage will be authorized.

Figure 2A:
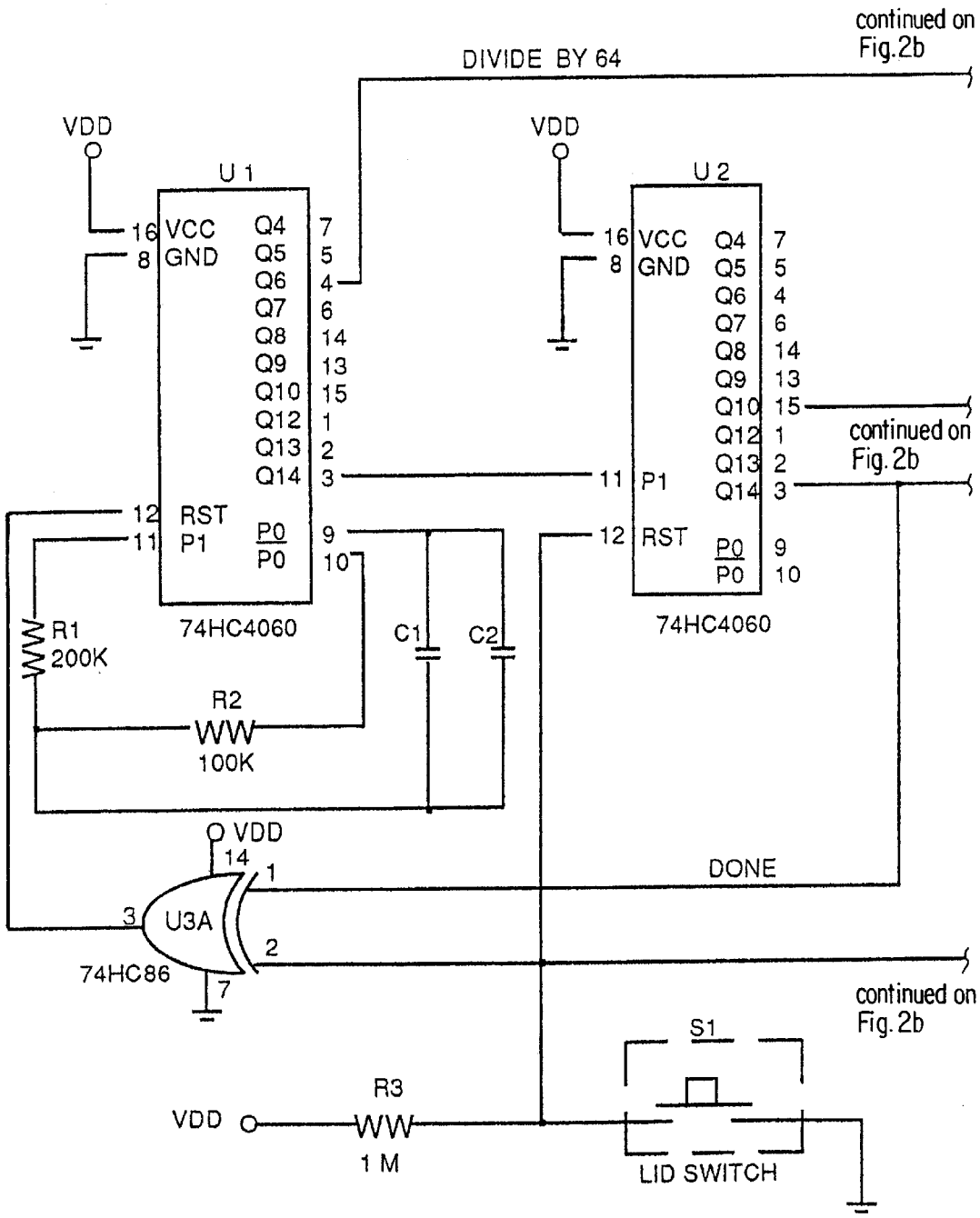
FIG. 2 shows a circuit diagram of a timing arrangement for actuating the display of FIG. 1.
Figure 2B:
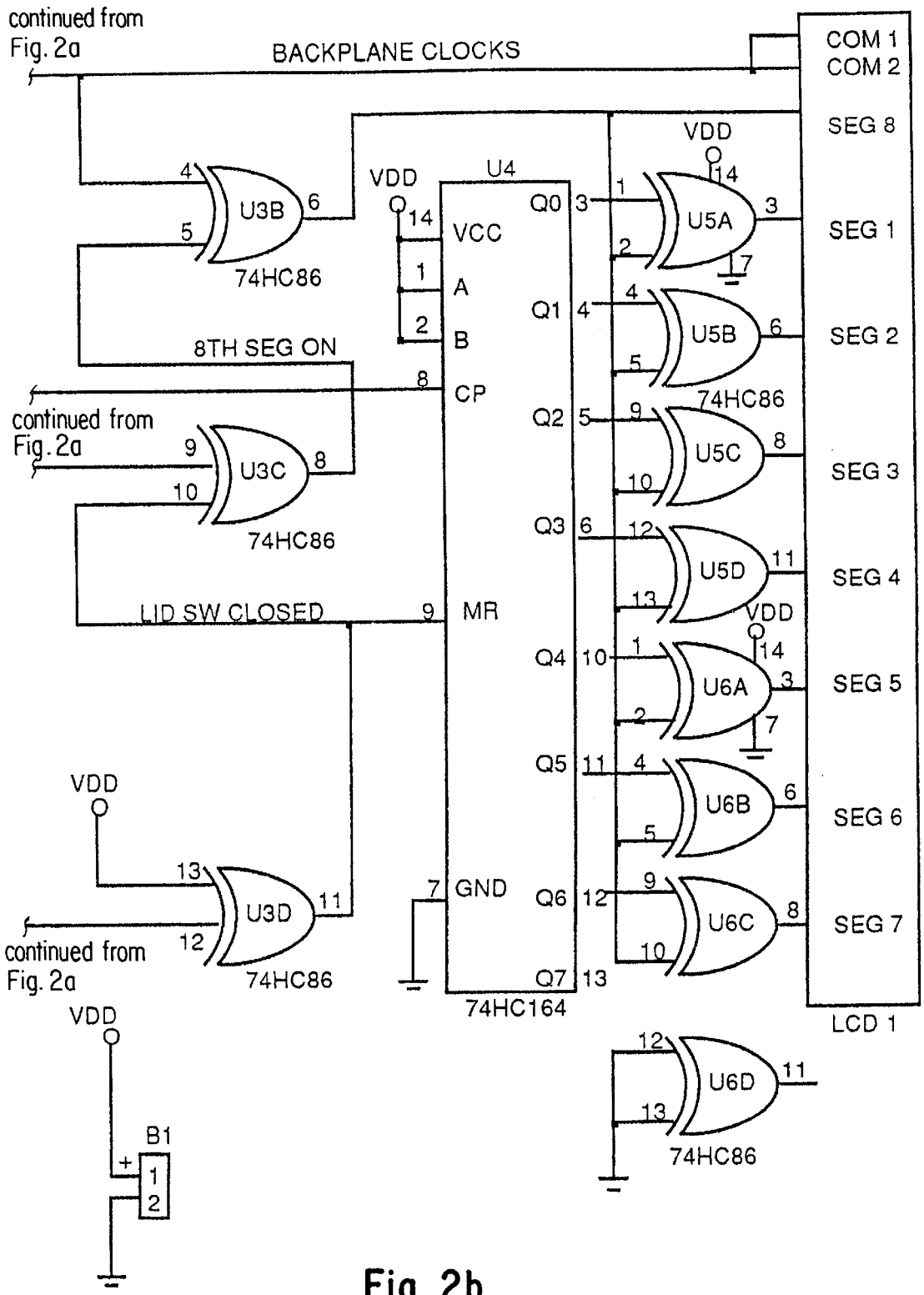

Techniques and apparatus for sequentially deactivating the vertical liquid crystal line segments in FIG. 1 as described above are well known and readily implemented by those skilled in the art, requiring a timer and a logical switching arrangement for sequentially de-energizing a series of LCD drivers. An example of such a circuit, which is made up of a lid switch S1, and R-C oscillator circuit and six commercially available integrated circuit packages, is shown in FIG. 2. The oscillator, which is provided by capacitors C1 and C2 and resistors $R_1$ and $R_2$ drives a counter in the integrated circuit package U1, which in turn drives a smaller circuit U2. An output from the latter is input to integrated circuit package $U_4$ which contains a shift register that sequentially turns off a series of exclusive OR circuits (in integrated circuits U5 and U6), each of which (in the example shown in FIG. 1) controls three vertical line segments of the liquid crystal display. An additional integrated circuit package $U_3$ is used as a gate package to feed back the gated most significant bit to shut the timer off when it reaches its full count. When the lid switch $S_1$ is opened and closed, (that is, the lid is removed and replaced) it resets the circuit and restarts the counting cycle.

Set forth below is a table of values for the capacitors $C_1$ and $C_2$, depending on the prescribed time interval:

TABLE OF VALUES FOR C1 & C2

| TIME (HR) | CLOCK (HZ) | TEST (HZ) | C1 (PF) | C2 (PF) |
|---|---|---|---|---|
| 2 | 18641 | 291.3 | 220 | NONE |
| 3 | 12428 | 194.2 | 330 | NONE |
| 4 | 9321 | 145.6 | 470 | NONE |
| 6 | 6214 | 97.1 | 680 | NONE |
| 8 | 4660 | 72.8 | 820 | 100 |
| 12 | 3107 | 48.5 | 1000 | 390 |
| 24 | 1553 | 24.3 | 2700 | NONE |

The circuit of FIG. 2 is of course merely illustrative; numerous other configurations well known to those skilled in the art can be implemented. In particular, it is apparent that twenty four separate drivers could be provided for deactivating each vertical line segment separately in FIG. 1, and that the number of vertical line segments can be varied at will.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A display arrangement for regulating dispensing of contents of a container at a predetermined time interval, comprising:

a substrate provided on a portion of the container;

a visually observable permissive indicator pattern provided on said substrate;

an electrically activatable display device disposed on said permissive indicator pattern, said electrically activatable display having a plurality of discrete separately activatable display elements which block visual observation of said permissive indicator pattern when activated; and means for sequentially deactivating said display elements with the passage of time following manipulation of said closure member so that visual observation of said permissive indicator pattern is progressively unblocked during said time interval and fully unblocked upon expiration of said time interval.

2. The display arrangement according to claim 1, wherein said substrate comprised a surface of said closure member.

3. The display arrangement according to claim 2, wherein said container is a medication or dietary supplement dispenser.

4. The display arrangement according to claim 1, wherein said display device comprises a liquid crystal display.

5. The display arrangement according to claim 1, wherein said display device comprises a plurality of parallel elongate display elements which collectively block or obscure said permissive indicator pattern when activated.

6. A container apparatus comprising:

a container for contents which are to be dispensed therefrom no more frequently than once per predetermined time period;

an access mechanism for opening and closing said container to dispense contents therefrom;

a sensor to detect closing of said access mechanism; and an electrically actuated display apparatus, activated when said sensor detects closing of said access mechanism, for warning a user of said container that said access mechanism has been operated with a preceding time period corresponding to said predetermined time period;

wherein said display apparatus comprises a visually observable permissive indicator provided on a surface of said container;

an electrically actuatable display device superimposed on said permissive indicator, said display device comprising a plurality of discrete separately activatable display segments which are opaque when activated, thereby blocking visual observation of said permissive indicator; and means for sequentially deactivating said display elements during said predetermined time interval following operation of said access mechanism, so that visual observation of said permissive indicator is progressively unblocked during said predetermined time interval and fully unblocked upon expiration thereof.

7. The container apparatus according to claim 6, wherein said electrically actuatable display device comprises a liquid crystal display having a plurality of separately actuatable liquid crystal display elements.

8. Closure apparatus for a container, comprising:

a closure member for controlling access to contents of said container;

a visually observable permissive indicator disposed on a surface of said closure member;

an electrically activatable display device disposed on said permissive indicator pattern, said display device having a plurality of discrete separately activatable display elements which block visual observation of said permissive indicator pattern when activated;

means for sequentially deactivating said display elements with the passage of time following manipulation of said closure member so that visual observation of said permissive indicator pattern is progressively unblocked during said time interval and fully unblocked upon expiration of said time interval.

9. Closure apparatus for a container according to claim 8, wherein said electrically actuatable display device comprises a liquid crystal display having a plurality of separately actuatable liquid crystal display elements.

10. The display arrangement according to claim 8, wherein said display device comprises a plurality of parallel elongate display elements which collectively block said permissive indicator pattern when activated.

11. A method for regulating dispensing of contents of a container at a predetermined time interval, comprising:

providing a visually observable permissive indicator on a surface of said container;

superimposing a progressively deactivatable opaque pattern over said permissive indicator, which opaque pattern blocks visual observation of said permissive indicator when activated;

activating said opaque pattern upon manipulation of a closure member of said container;

progressively deactivating said opaque pattern with passage of time so that said permissive indicator is progressively unblocked during said predetermined time interval and is fully unblocked upon expiration of said predetermined time interval.

12. A method for regulating dispensing of contents of a container at a predetermined time interval according to claim 11, wherein said surface of said container is a surface on a closure member of said container.

13. A method for regulating dispensing of contents of a container at a predetermined time interval according to claim 11, wherein said opaque pattern comprises a plurality of separately activatable opaque segments; and said step of progressively deactivating said opaque pattern comprises deactivating said segments in a spacially sequential manner.

* * * * *